US005319935A

United States Patent [19]

Toon et al.

[11] Patent Number: 5,319,935

[45] Date of Patent: Jun. 14, 1994

[54] STAGED GAS TURBINE COMBUSTION CHAMBER WITH COUNTER SWIRLING ARRAYS OF RADIAL VANES HAVING INTERJACENT FUEL INJECTION

[75] Inventors: Ian J. Toon, Leicester; Stephen J. O'Dell, Coventry; John H. Currin, Nuneaton; Jeffrey D. Willis, Coventry, all of England

[73] Assignee: Rolls-Royce plc, London, England

[21] Appl. No.: 39,133

[22] PCT Filed: Sep. 26, 1991

[86] PCT No.: PCT/GB91/01658

§ 371 Date: Apr. 13, 1993

§ 102(e) Date: Apr. 13, 1993

[87] PCT Pub. No.: WO92/07221

PCT Pub. Date: Apr. 30, 1992

[30] Foreign Application Priority Data

Oct. 23, 1990 [GB] United Kingdom ..... 9023004

[51] Int. Cl.[5] ..... F23R 3/14; F23K 3/34

[52] U.S. Cl. ..... 60/733; 60/737; 60/746; 60/748; 239/403

[58] Field of Search ..... 60/733, 742, 748, 737, 60/746; 239/403

[56] References Cited

U.S. PATENT DOCUMENTS

| | | | |
|---|---|---|---|
| 3,811,278 | 5/1974 | Taylor et al. . | |
| 3,972,182 | 8/1976 | Salvi | 60/748 |
| 4,112,676 | 9/1978 | Decorso | 60/733 |
| 4,765,146 | 8/1988 | Hellat et al. | 60/746 |
| 4,910,957 | 3/1990 | Moreno et al. . | |
| 5,062,792 | 11/1991 | Maghon | 60/748 |
| 5,069,029 | 12/1991 | Kuroda et al. | 60/737 |

FOREIGN PATENT DOCUMENTS

| | | | |
|---|---|---|---|
| 1039785 | 9/1958 | Fed. Rep. of Germany . | |
| 3819898 | 12/1989 | Fed. Rep. of Germany . | |
| 2085942 | 12/1971 | France . | |
| 2121496 | 8/1972 | France . | |
| 0093210 | 4/1990 | Japan | 60/737 |

*Primary Examiner*—Louis J. Casaregola
*Assistant Examiner*—Timothy S. Thorpe
*Attorney, Agent, or Firm*—Cushman, Darby & Cushman

[57] ABSTRACT

Gas turbine engine combustion chamber has staged combustion to reduce nitrous oxides and includes a first radial flow swirler and a second radial flow swirler located axially of an annular mixing zone with each swirler having vanes for rotating the incoming air in substantially opposite directions relative to each other; first and second fuel injectors are provided with a first fuel injectors located in one of the passages of each of the first and second swirlers and with the second fuel injectors located upstream of the passages of the first and second swirlers.

37 Claims, 6 Drawing Sheets

STAGED GAS TURBINE COMBUSTION CHAMBER WITH COUNTER SWIRLING ARRAYS OF RADIAL VANES HAVING INTERJACENT FUEL INJECTION

The present invention relates to a gas turbine combustion chamber, and to a method of operating a gas turbine engine combustion chamber.

In order to meet emission level requirements for industrial low emission gas turbine engines, the engine combustion chamber volumes has been increased. Currently industrial gas turbine engines use annular or can-annular combustion chambers. The requirement to increase the volume of the combustion chamber assembly whilst incorporating the combustion chamber assembly in the same axial length has necessitated the use of a plurality of tubular combustion chambers, whose longitudinal axes are arranged in generally radial directions. The inlets of the tubular combustion chambers are at their radially outer ends, and transition ducts connect the outlets of the tubular combustion chambers with a row of nozzle guide vanes to discharge the hot exhaust gases axially into the turbine sections of the gas turbine engine.

Also in order to meet the emission level requirements, staged combustion is required in order to minimise the quantity of the oxides of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature, and this requires premixing of the fuel and all the combustion air before combustion takes place. The oxides of nitrogen (NOx) are commonly reduced by a method which uses two stages of fuel injection. Our UK patent no. 489339 discloses two stages of fuel injection to reduce NOx. In staged combustion, both stages of combustion seek to provide lean combustion and hence the low combustion temperatures required to minimise NOx. The term lean combustion means combustion of fuel in air where the fuel to air ratio is low i.e. less than the stoichiometric ratio.

The present invention seeks to provide a novel gas turbine combustion chamber, and a novel method of operating a gas turbine engine combustion chamber.

Accordingly the present invention provides a gas turbine engine combustion chamber comprising first air intake means, primary fuel injector means and a first fuel and air mixing zone, the first fuel and air mixing zone being defined by at least one annular wall and an upstream wall connected to the upstream end of the annular wall, the upstream wall having at least one aperture, the first air intake means comprising at least one first radial flow swirler and at least one second radial flow swirler, each first radial flow swirler being arranged to supply air into the first fuel and air mixing zone through said aperture, each second radial flow swirler being arranged to supply air into the first fuel and air mixing zone through said aperture, each first radial flow swirler being positioned axially downstream of the respective second radial flow swirler with respect to the axis of the combustion chamber, each first radial flow swirler being arranged to swirl air in the opposite direction to the respective second radial flow swirler, the primary fuel injector means being arranged to supply fuel into at least one of the passages defined between the vanes of each of the first radial flow swirlers and into at least one of the passages defined between the vanes of each of the second radial flow swirlers.

Preferably at least one pilot fuel injector is provided, each pilot fuel injector is aligned with a respective one of the apertures to supply fuel into the first fuel and air mixing zone.

Preferably the primary fuel injector means is arranged to supply fuel into all the passages defined between the vanes of the first radial flow swirler.

Preferably the primary fuel injector means is arranged to supply fuel into all the passages defined between the vanes of the second radial flow swirler.

Preferably the primary fuel injector means is arranged to supply fuel into the radially outer region of the passages between the vanes.

The primary fuel injector means may comprise a hollow cylindrical member arranged to extend axially with respect to the combustion chamber, the cylindrical member has a plurality of apertures spaced apart axially along the cylindrical member to inject fuel into the passages.

The apertures may be arranged to direct the fuel radially inwardly.

The primary fuel injector means may be arranged to inject gas fuel or evaporated liquid fuel.

The pilot fuel injector may be arranged to inject gas fuel, or liquid fuel.

The combustion chamber may be tubular and has a single aperture in its upstream wall.

The combustion chamber may further comprise secondary air intake means, secondary fuel injector means and a secondary fuel and air mixing zone, the secondary fuel and air mixing zone is annular and surrounds the first fuel and air mixing zone, the secondary fuel and air mixing zone being defined at its radially outer extremity by a second annular wall, the secondary fuel injector means being arranged to supply fuel into the upstream end of the secondary fuel and air mixing zone, the secondary fuel and air mixing zone being an fluid flow communication at its downstream end with the interior of the combustion chamber downstream of the first fuel and air mixing zone.

The secondary air intake may be downstream of the first air intake means.

The secondary fuel and air mixing zone may be defined at its radially inner extremity by a third annular wall.

The annular wall may have a first portion defining the first fuel and air mixing zone, a second portion of increased diameter downstream of the first portion and a third frusto conical portion interconnecting the first and second portions.

The third conical portion may have a plurality of equi-circumferentially spaced apertures arranged to direct the secondary fuel and mixture from the secondary fuel and air mixing zone as a plurality of jets in a downstream direction towards the centre line of the combustion chamber.

The apertures may be slots.

The downstream end of the second annular wall may be secured to the third conical portion of the annular wall.

Cooling air may be supplied to an annular chamber defined between the annular wall and the third annular wall.

The secondary fuel injector means may comprise a plurality of equi-circumferentially spaced fuel injectors.

The secondary fuel injector means may be arranged to inject gas fuel or evaporated liquid fuel.

The downstream end of the first portion of the annular wall reduces in diameter to a throat.

The combustion chamber may comprise tertiary air intake means, tertiary fuel injector means and a tertiary fuel and air mixing zone, the tertiary fuel and air mixing zone is annular and surrounds the secondary combustion zone, the tertiary fuel and air mixing zone is defined at its radially outer extremity by a fourth annular wall, the tertiary fuel injector means is arranged to supply fuel into the upstream end of the tertiary fuel and air mixing zone, the tertiary fuel and air mixing zone is in fluid flow communication at its downstream end with a tertiary combustion zone in the interior of the combustion chamber downstream of the secondary combustion zone.

The annular wall may have a fourth portion of larger diameter than the second portion downstream of the second portion and defining the tertiary combustion zone, a fifth frusto conical portion interconnecting the second and fourth portions.

The downstream end of the second portion of the annular wall may reduce in diameter to a throat.

The tertiary air intake may be downstream of the second air intake means.

The tertiary fuel and air mixing zone may be defined at its radially inner extremity by a fifth annular wall.

The fifth conical portion may have a plurality of equi-circumferentially spaced apertures arranged to direct the tertiary fuel and air mixture from the tertiary fuel and air mixing zone as a plurality of Jets in a downstream direction towards the centreline of the combustion chamber.

The apertures may be slots.

The downstream end of the fourth annular wall may be secured to the fifth conical portion of the annular wall.

The tertiary fuel injector means may comprise a plurality of equi-circumferentially spaced fuel injectors.

The tertiary fuel injectors means may be arranged to inject gas fuel or evaporated liquid fuel.

Fuel may only be supplied from the pilot fuel injector into the first fuel and air mixing zone from the start of operation of the gas turbine engine until a predetermined output power level is obtained, fuel is supplied from the primary fuel injector means into at least one of the passages defined between the vanes of the first radial flow swirler and into at least one of the passages defined between the vanes of the second radial flow swirler to flow into the first fuel and air mixing zone for output power levels greater than the predetermined level, and simultaneously fuel is supplied from the secondary fuel injector means into the secondary fuel and air mixing zone to flow into the interior of the combustion chamber downstream of the first fuel and air mixing zone.

Fuel may be supplied from the pilot fuel injector only into the first fuel and air mixing zone from the start of operation of the gas turbine engine until a predetermined output power level is obtained, supplying fuel from the primary fuel injector means into at least one of the passages defined between the vanes of the first radial flow swirler and into at least one of the passages defined between the vanes of the second radial flow swirler to flow into the first fuel and air mixing zone for output power levels greater than a predetermined level, and simultaneously supplying fuel into the secondary fuel and air mixing zone to flow into the secondary combustion zone in the interior of the combustion chamber downstream of the first fuel and air mixing zone, supplying fuel into the tertiary fuel and air mixing zone to flow into the tertiary combustion zone in the interior of the combustion chamber downstream of the secondary combustion zone for output power levels greater than a second predetermined level and for ambient air temperatures greater than a predetermined temperature.

The predetermined output power level may be 35 to 40% power.

The present invention will be more fully described by way of example with reference to the accompanying drawings, in which.

Figure 1:
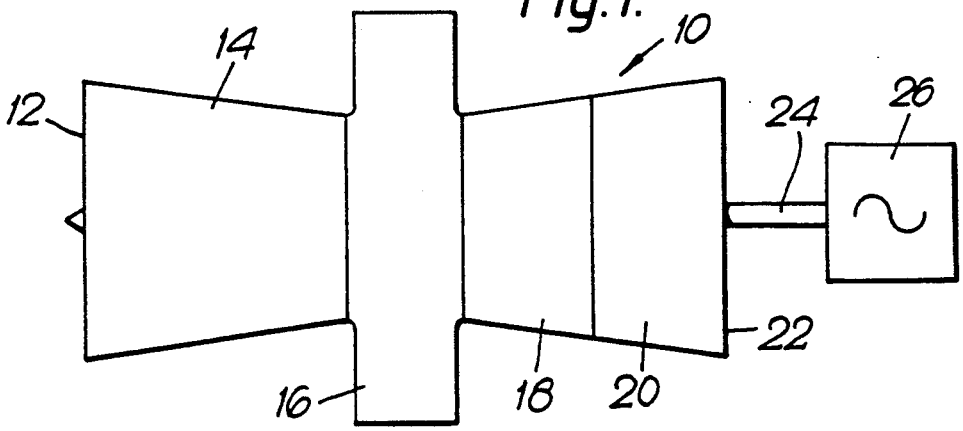
FIG. 1 is a view of a gas turbine engine having a combustion chamber assembly and fuel injector according to the present invention.
Figure 4:
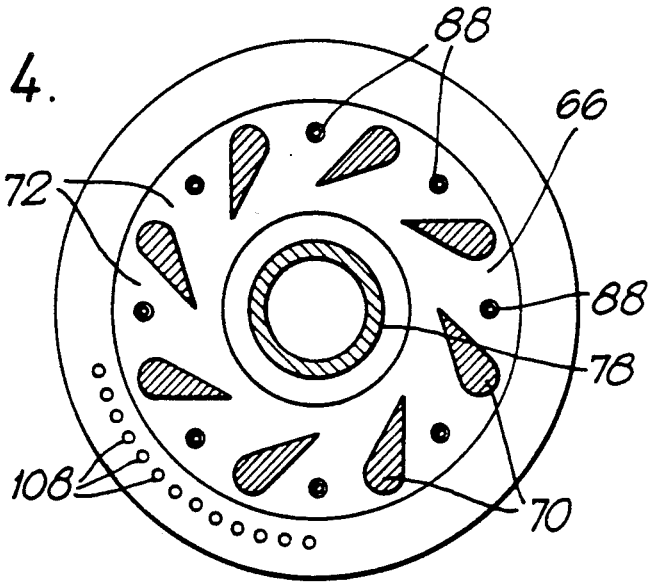
FIG. 4 is a cross-section in the direction of arrows G—G in FIG. 3.
Figure 5:
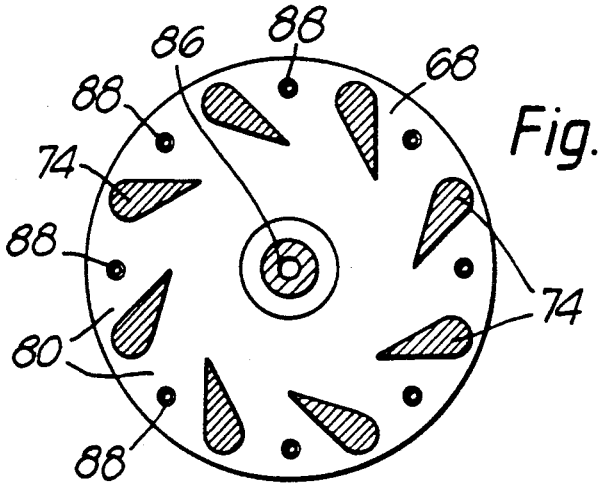
FIG. 5 is a cross-sectional view in the direction of arrows H—H in FIG. 3.
Figure 2:
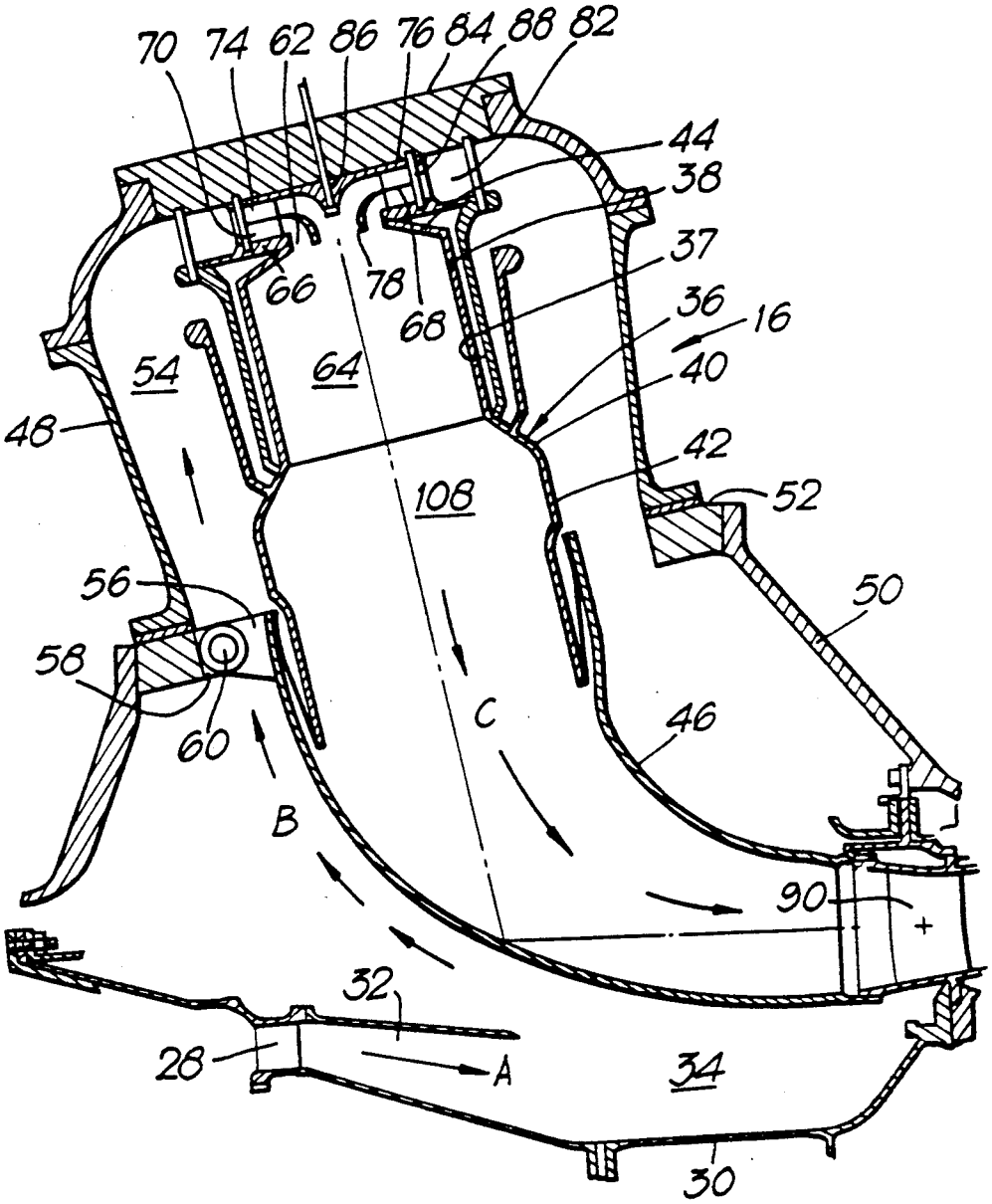
FIG. 2 is an enlarged longitudinal cross-sectional view through the combustion chamber shown in FIG. 1.
Figure 3:
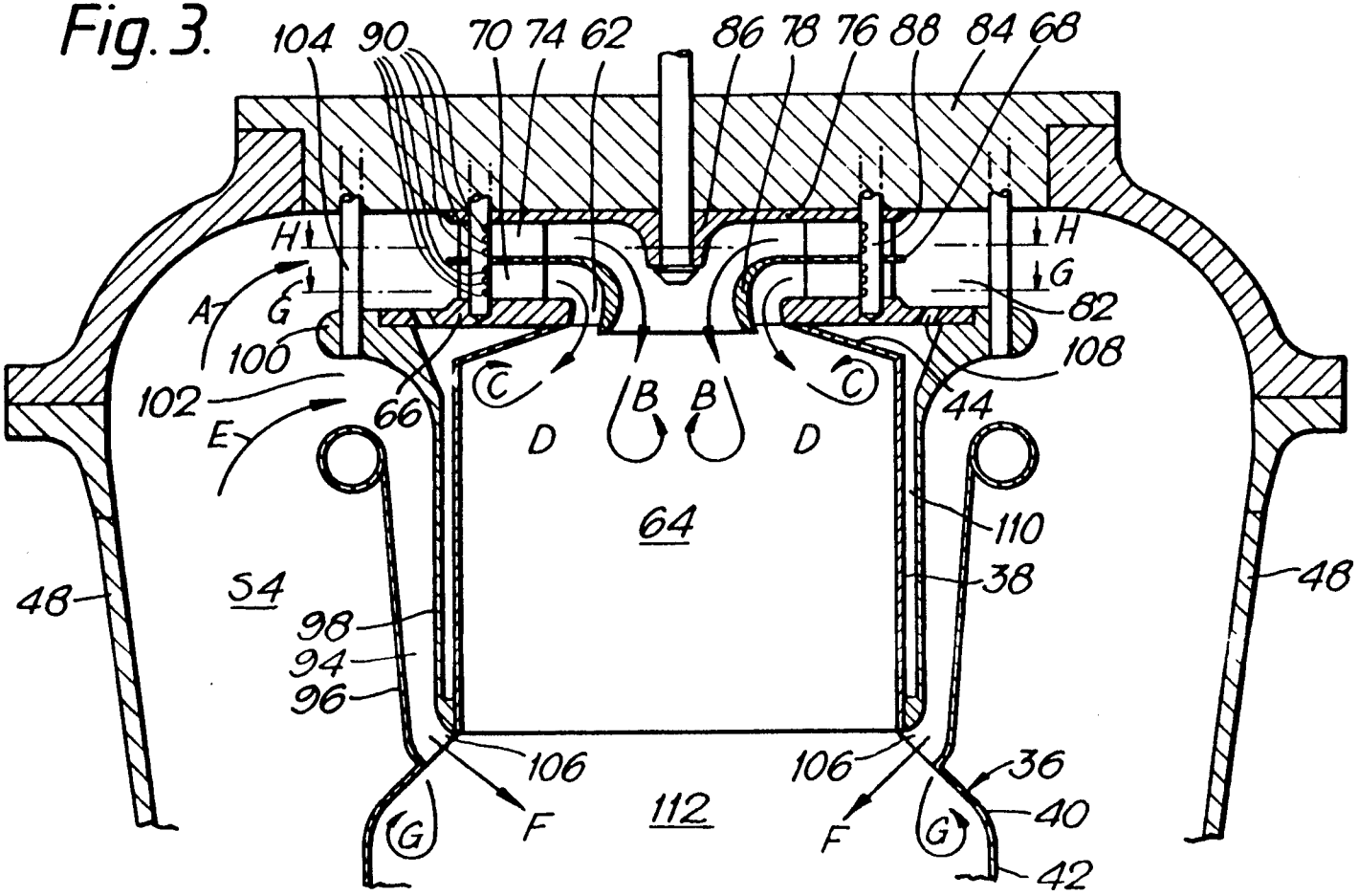
FIG. 3 is a further enlarged longitudinal cross-sectional view through the upstream end of the combustion chamber assembly shown in FIG. 2.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14 via one or more shafts (not shown). The power turbine section 20 is arranged to drive an electrical generator 26, via a shaft 24. However the power turbine section 20 may be arranged to provide drive for other purposes. The operation of the gas turbine engine 10 is quite conventional, and will not be discussed further.

The combustion chamber assembly 16 is shown more clearly in FIGS. 2 to 5. A plurality of compressor outlet guide vanes 28 are provided at the axially downstream end of the compressor section 14, to which is secured at their radially inner ends an inner annular wall 30 which defines the inner surface of an annular chamber 34. A diffuser is defined between an annular wall 32 and the upstream portion of the inner annular wall 30. The downstream end of the inner annular wall 30 is secured to the radially inner ends of a row of nozzle guide vanes 90 which direct hot gases from the combustion chamber assembly 16 into the turbine section 18.

The combustion chamber assembly 16 comprises a plurality of equally circumferentially spaced tubular combustion chambers 36. The axes of the tubular combustion chambers 36 are arranged to extend in generally radial directions. The inlets of the tubular combustion chambers 36 are at their radially outermost ends and their outlets are at their radially innermost ends.

Each of the tubular combustion chambers 36 comprises an upstream wall 44 secured to the upstream end of an annular wall 37. A first, upstream, portion 38 of the annular wall 37 defines a first fuel and air mixing zone 64, and a second, downstream portion 42 of the annular wall is interconnected with the first portion 38 by a third portion 40. The second portion 42 of the annular wall has a greater diameter than the first portion 38, and the third portion 40 is frusto conical.

A plurality of equally circumferentially spaced transition ducts 46 are provided, and each of the transition ducts 46 has a circular cross-section at its upstream end. The upstream end of each of the transition ducts 46 is located coaxially around the downstream end of a corresponding one of the tubular combustion chambers 36, and each of the transition ducts 46 connects and seals with an angular section of the nozzle guide vanes 90.

A plurality of cylindrical casings 48 are provided, and each cylindrical casing 48 is located coaxially around a respective one of the tubular combustion chambers 36. Each cylindrical casing 48 is secured to a respective boss 52 on an annular engine casing 50. A number of chambers 54 are formed between each tubular combustion chamber 36 and its respective cylindrical casing 48.

The upstream end of each transition duct 46 has a bracket 56 which extends radially, with respect to the upstream end of the transition duct, and the engine casing 50 has a plurality of pairs of brackets 58. Each bracket 56 is pivotally secured to a respective one of the pairs of brackets 58 by a pin 60, to provide a pivot mounting which is described more fully in our copending UK patent application no. 9019089.3 filed Sept. 1, 1990.

The upstream wall 44 of each of the tubular combustion chambers 36 has an aperture 62 to allow the supply of air and fuel into the first fuel and air mixing zone 64. A plurality of first radial flow swirlers are provided and each first radial flow swirler is arranged coaxially with the aperture 62 in the upstream wall 44 of the respective tubular combustion chamber 36. Similarly a plurality of second radial flow swirlers are provided and each second radial flow swirler is arranged coaxially with the aperture 62 in the upstream wall 44 of the respective tubular combustion chamber 36. The first radial flow swirlers are positioned axially downstream, with respect to the axis of the tubular combustion chamber, of the second radial flow swirlers.

Each first radial flow swirler comprises a first side plate 66, a second side plate 68 and a plurality of first vanes 70. The first side plate 66 has a central aperture arranged coaxially with the aperture 62 in the upstream wall 44, and the plate 66 is secured to the upstream wall 44. The first vanes 70 extend axially between and are secured to the first and second side plates 66 and 68 respectively. A number of passages 72 are formed between the first vanes 70 for the flow of air. Each second radial flow swirler comprises a plurality of second vanes 74 and a third side plate 76. The second vanes 74 extend axially between the second side plate 68 and the third side plate 76. The second side plate 68 has a central aperture arranged coaxially with the aperture 62 in the upstream wall 44, and has a shaped annular lip 78 which extends in an axially downstream direction into the aperture 62. A number of passages 80 are formed between the second vanes 74 for the flow of air. The first and second vanes 70,74 of the first and second radial flow swirlers are arranged to swirl air in opposite directions, as seen from FIGS. 4 and 5. A first annular air intake 82 is defined axially between the radially outer end of each first side plate 66 and a closure plate 84 at the outer end of each cylindrical casing 48.

A plurality of pilot fuel injectors 86 are provided, and each pilot fuel injector 86 is arranged coaxially with the aperture 62 of one of the tubular combustion chambers 36 to supply fuel through the aperture 62 into the first fuel and air mixing zone 64. A plurality of primary fuel injectors 88 are provided for each of the tubular combustion chambers 36. Each of the primary fuel injectors 88 comprises a hollow cylindrical member which extends axially with respect to the tubular combustion chamber 36. Each of the hollow cylindrical members passes axially through the third side plate 76 and the second side plate 68 and locates in a blind hole in the first side plate 66. Each of the hollow cylindrical members is arranged to pass axially through one of the passages 80 between the second vanes 74 and through one of the passages 72 between the first vanes 70. The hollow cylindrical members are positioned towards the radially outer region of the passages 72,80, and have axially spaced apertures 90 to inject fuel into the first radial flow swirler assembly and axially spaced apertures 92 to inject fuel into the second radial flow swirler assembly. The apertures 90 and 92 are arranged to direct the fuel radially inwardly.

A second annular fuel and air mixing zone 94 surrounds the first fuel and air mixing zone 64 of each tubular combustion chamber 36. Each second annular fuel and air mixing zone 94 is defined between a second annular wall 96 and a third annular wall 98. The second annular wall 96 defines the radially outer extremity of the second fuel and air mixing zone 94 and the third annular wall 98 defines the radially inner extremity of the second fuel and air mixing zone 94. The axially upstream end 100 of each third annular wall 98 is secured to the first side plate 66 of the first radial flow swirler of the respective tubular combustion chamber 36. A second annular air intake 102 is defined axially between the upstream end of each second annular wall 96 and the upstream end 100 of the respective third annular wall 98 to supply air into the second annular fuel and mixing zones 94.

A plurality of secondary fuel injectors 104 are provided for each of the tubular combustion chambers 36. Each of the secondary fuel injectors 104 comprises a hollow cylindrical member which extends axially with respect to the tubular combustion chamber 36. Each of the hollow cylindrical members passes axially through the upstream end 100 of the third annular wall 98 to supply fuel into the second fuel and air mixing zone 94.

Each second and third annular wall 96,98 is arranged coaxially around the first portion 38 of the respective annular wall. At the downstream end of each second annular fuel and air mixing zone 94, the second and third annular walls 96 and 98 are secured to the respective third frusto conical portion 40, and each frusto conical portion 40 is provided with a plurality of circumferentially spaced apertures 106 which are arranged to direct fuel and air into a second combustion zone 112 in the tubular combustion chambers 36, in a downstream direction towards the axis of the tubular combustion chamber 36. The apertures 106 may be circular or slots.

Each first side plate 66 is provided with a plurality of apertures 108 to supply cooling air into an annular space 110 between the upstream portion 38 of the annular wall and the third annular wall 98 for cooling of the annular wall.

The annular wall may be formed from a laminated structure comprising spaced perforated inner and outer sheets which give transpiration cooling of the annular wall.

In operation primary air A flows through the first air intake 82 and through the first and second radial flow swirlers. The lips 78 direct the primary air into the first fuel and air mixing zone or primary combustion zone 64. The flows of air from the first and second radial flow swirlers are in opposite directions and this produces opposed flow vortices B and C. A shear layer D is formed between the vortices B and C which improves mixing turbulence.

The pilot injectors 86 only are used at low power settings, that is less than about 40% power. They inject gas or pre-evaporated liquid fuel at a narrow angle only into the primary air which has passed through the second radial flow swirlers to create a locally fuel rich mixture on the axes of the tubular combustion chambers 36. Diffusion causes the fuel to mix with the primary air in the vortex B. Vortex C remains an air only region. Thus a locally fuel rich mixture is created on the combustion chamber 36 centreline which sustains combustion in the primary combustion zone 64.

The primary fuel injectors 88 are not used, during low power operation, and thus only primary air exits from the downstream end of the passages 72 and 80 formed between the respective vanes 70 and 74 of the first and second swirler assemblies.

At high power settings, at or greater than about 40% power, the pilot injectors 86 are not used, and all the fuel supplied into the combustion chamber 36 is supplied from the primary and secondary injectors 88 and 104 respectively.

At high power settings, at or greater than 40% power, the primary fuel injectors 88 inject gas, or pre-evaporated liquid fuel, into the passages 72 and 80 formed between the respective vanes 70 and 74 of the first and second swirler assemblies. Simultaneously the secondary fuel injectors 104 inject gas, or pre-evaporated liquid fuel, into the second fuel and air mixing zone 94 to mix with secondary air entering the second fuel and air mixing zone 94 through the second annular intake 102.

The first and second radial flow swirler assemblies direct the fuel and air mixture towards the centreline of the tubular combustion chamber 86 before it is turned so that it flows parallel to the centreline of the combustion chamber 36. The fuel is entrained into both vortex B and vortex C which have opposite swirl, and the shear layer D between the two vortices improves the mixing turbulence. There is no net swirl in the tubular combustion chamber 36 and therefore the gases diffuse quickly back to the centreline of the tubular combustion chamber 36 in primary combustion zone 64 enabling the volume of the tubular combustion chamber 36 to be minimised and also minimising mixing with cooling air on the inner surface of the upstream portion 38 of the combustion chamber 36. This minimises heat transfer to the upstream portion 38 of the combustion chamber, allows more efficient use of the cooling air and thus improves combustion efficiency.

Secondary air E flows through the second air intake 102 into the secondary air and fuel mixing zone 94. The secondary air and fuel is mixed as it flows axially downstream through the second fuel and air mixing zone 94. The resulting fuel and air mixture formed in the secondary air and fuel mixing zone 94 is injected through the apertures 106 into the second downstream portion 42 of the tubular combustion chamber 36 where secondary combustion occurs in the second combustion zone 112. The fuel and air mixture injected from the second fuel and air mixing zone 94 is in the form of discrete Jets F which are directed in a downstream direction towards the centreline of the tubular combustion chamber 36. This ensures good penetration of the secondary fuel and air mixture into the gases from the primary combustion zone 64 and hence good mixing. Interaction of the secondary fuel and air mixture Jets F with cooling air flowing over the inner surfaces of the downstream portion 42 of the combustion chamber 36 is minimised because of this angling of the jets F towards the centreline of the combustion chamber.

Figure 6:
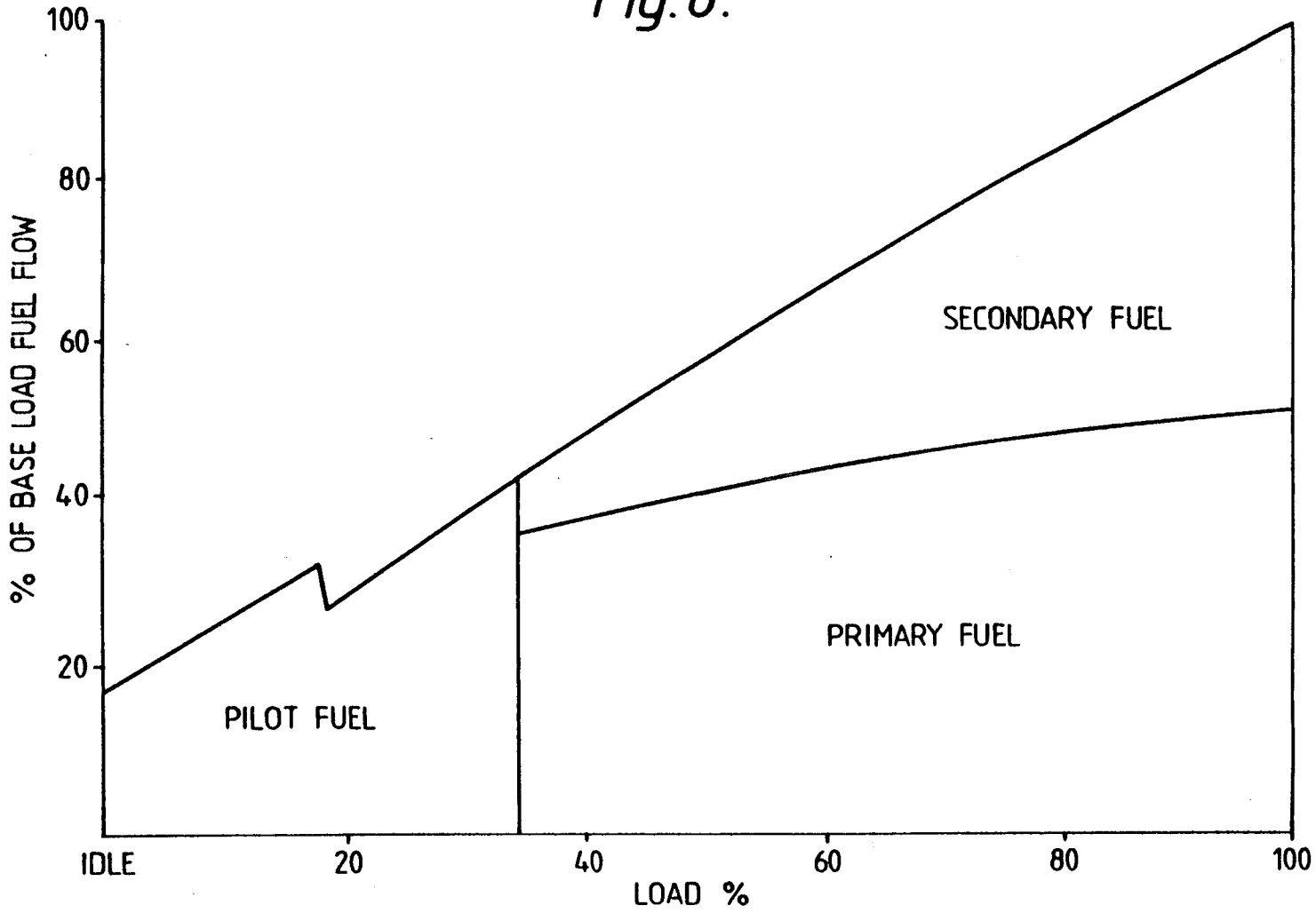
FIG. 6 is a graph of percentage base load fuel flow versus percentage load for the combustion chamber shown in FIG. 3.

The graph in FIG. 6 illustrates how the fuel flow to the pilot, primary and secondary injectors 86,88 and 104 respectively varies with the power, or load, setting of the gas turbine engine.

Only the pilot injectors 86 are supplied with fuel at power settings below 35% power. At power settings above 35% fuel is supplied simultaneously to the primary and secondary injectors 88 and 104, and the supply of fuel to the pilot injectors 86 is terminated. At a power, or load setting of 35%, 83% of the fuel supplied to each combustion chandler is supplied to the primary injectors 88 and the remaining of the fuel is supplied to the secondary injectors 104. As the power, or load, setting is increased the total quantity of fuel supplied to each combustor increases and the total quantity of fuel supplied to the primary injectors and secondary injectors increases. The percentage of the total fuel supplied to the combustion chamber, which is supplied to the primary injectors 88 decreases gradually from 83% at 35% power setting to approximately 50% at 100% power setting. The percentage of the total fuel supplied to the combustion chamber which is supplied to the secondary injectors 104 increases gradually from 17% at 35% power setting to approximately 50% at 100% power setting.

The percentage of fuel supplied to the primary injectors 88 preferably decreases gradually from 28% at 40% power setting to 50% at 100% power setting whilst the percentage of fuel supplied to the secondary injectors 104 increases from 22% at 40% power setting to 50% at 100% power setting.

The first fuel and air mixing zone 64 is supplied with fuel so that it has a constant maximum temperature of 1800° K. (1527° C.) to prevent disassociation of nitrogen at higher temperatures, and hence prevent the formation of NOx.

The second combustion zone 112 is supplied with fuel so that it also has a constant maximum temperature of 1800° K. (1527° C.),and has a minimum temperature of 1500° K. (1227° C.) to prevent the build up of carbon monoxide etc. Preferably the mimimum temperature is 1550° K. The heat liberated in the first fuel and air mixing zone 64 heats the secondary air in the second fuel and air mixing zone 94.

In the combustion chamber 36 shown in FIGS. 2 to 5, it is required that the temperature of the flame in the first fuel and air mixing zone 64 remains substantially constant, or within a predetermined range of temperatures, so that the emissions of NOx remains low. However, with variations of power setting between 35% and 100% power, the margin between the required flame temperature and the temperature at which the flame is extinguished varies. In some circumstances the flame may be extinguished in the first fuel and air mixing zone. In order to provide an adequate margin between the flame temperature and the temperature at which the flame is extinguished, a greater proportion of fuel could be supplied to the first fuel and air mixing zone 64. However, this solution is not desirable because the flame temperature is increased and thus the emissions of NOx is increased.

Figure 7:
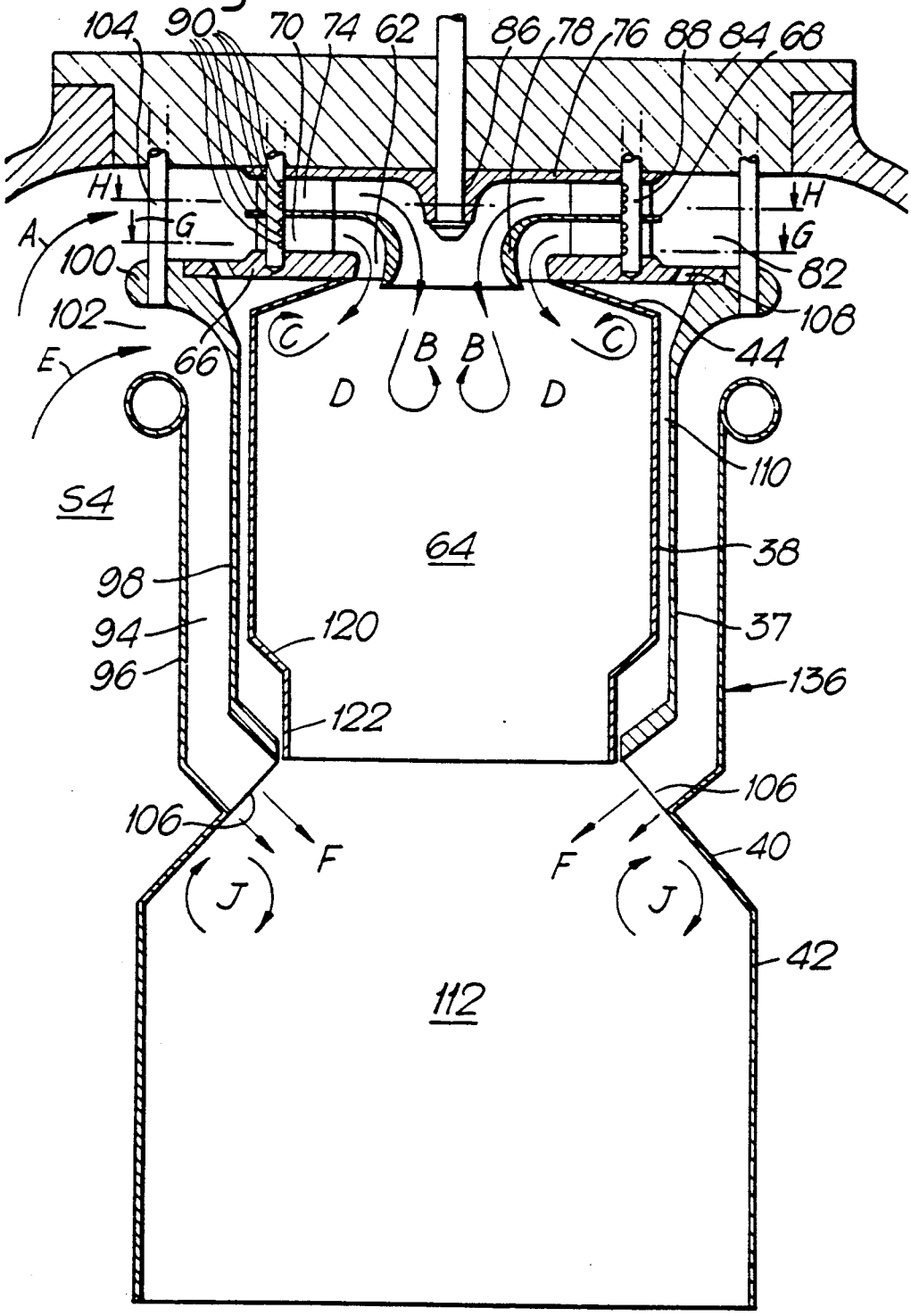
FIG. 7 is an enlarged longitudinal cross-sectional view through the upstream end of an alternative combustion chamber assembly according to the present invention.

An alternative combustion chamber assembly 136, shown in FIG. 7, is substantially the same as that shown in FIGS. 2 to 5 and the same reference numerals have been used to designate like parts. The combustion chamber assembly 136 differs from that shown in FIGS. 2 to 5 in that the downstream end of the first portion 38 of the annular wall 37 has a frusto conical portion 120 which reduces in diameter to a throat 122. The third frustoconical portion 40 interconnects the first portion 38 and the second portion 42, and the second portion 42 still has a greater diameter than the first portion 38.

The reduction in diameter at the downstream end of the first portion 38, provided by the frustoconical portion 120 and the throat 112, enhances the recirculation of hot combustion products into the first fuel and air mixing zone, or primary combustion zone 64, to reignite the fuel and air mixture. This, it is believed, also minimises or prevents secondary air flowing from the second fuel and air mixing zone 94 into the first fuel and air mixing zone 64 or primary combustion zone. The reduction in diameter at the downstream end of the first portion 38, in combination with a constant temperature in the first fuel and air mixing zone or combustion zone 64 allows a suitable margin between the flame temperature and the temperature at which the flame is extinguished to be maintained with variations of power setting between 35% and 100% power to prevent the flame in the first fuel and air mixing zone 64 being extinguished.

The fuel flows to the pilot, primary and secondary injectors 86,88 and 104 respectively varies with the power setting of the gas turbine engine in the same manner as that illustrated in FIG. 6.

The combustion chambers shown in FIGS. 2 to 5 and in FIG. 7 are suitable for operation across the full power range for ambient air temperatures in the range of −30° C. to +30° C. or higher.

Figure 8:
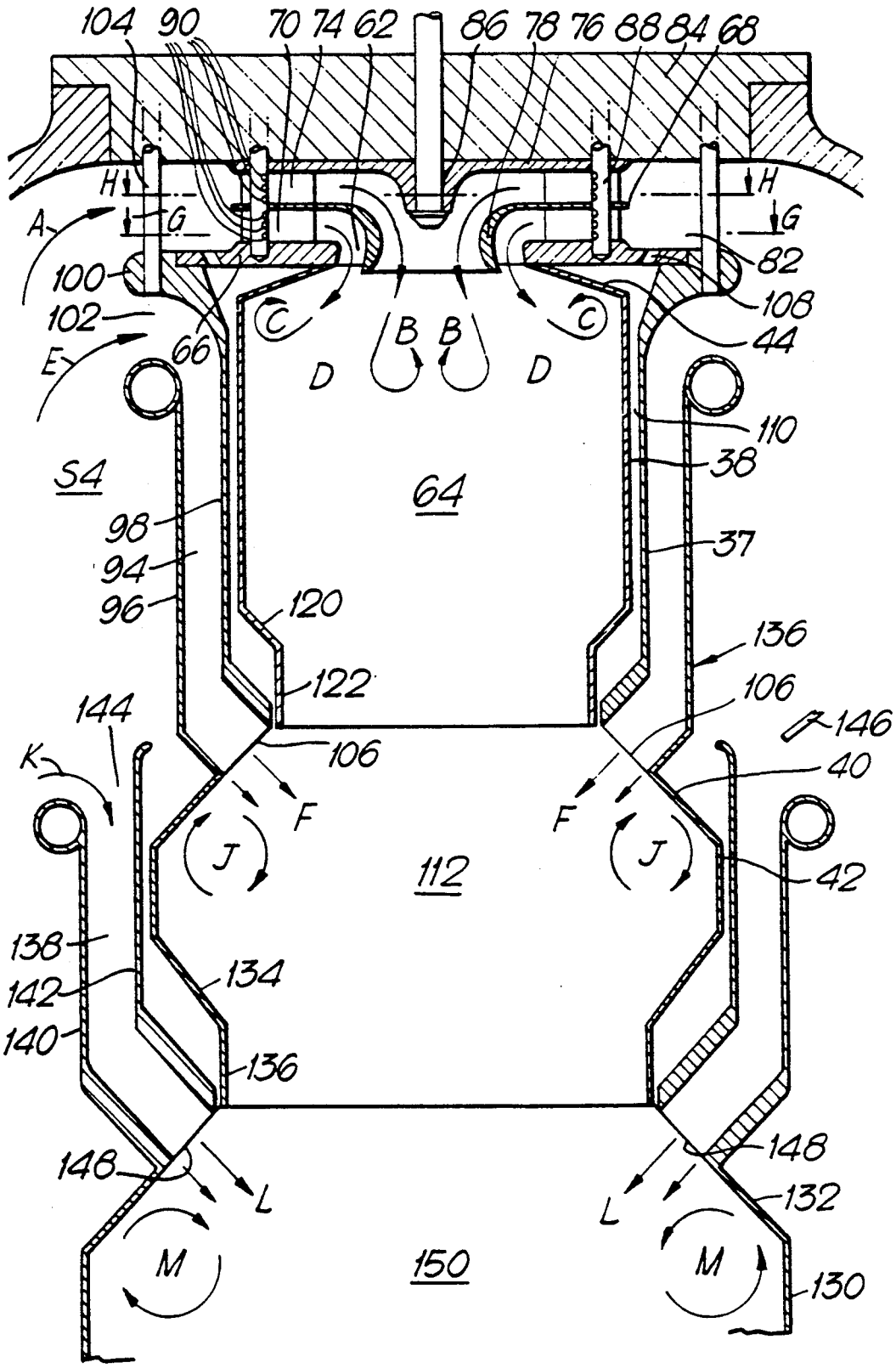
FIG. 8 is an enlarged longitudinal cross-sectional view through the upstream end of a further combustion chamber assembly according to the present invention.

A further combustion chamber assembly 236, shown in FIG. 8, is similar to that shown in FIG. 7 and the same reference numerals have been used to designate like parts. The combustion chamber assembly 236 differs from that shown in FIG. 7 in that each of the tubular combustion chambers 236 also comprises a fourth portion 130 positioned downstream of and interconnected to, the second portion 42 by a fifth portion 132. The fourth portion 130 of the annular wall has a greater diameter than the second portion 40, and the fifth portion 132 is frustoconical. The downstream end of the second portion 42 of the annular wall 37 has a frustoconical portion 134 which reduces in diameter to a throat 136.

A third annular fuel and air mixing zone 138 surrounds the second combustion zone 112 of each tubular combustion chamber 236. Each third annular fuel and air mixing zone 138 is defined between a fourth annular wall 140 and a fifth annular wall 142. The fourth annular wall 140 defines the radially outer extremity of the third fuel and air mixing zone 138 and the fifth annular wall 142 defines the radially inner extremity of the third fuel and air mixing zone 138. A third annular air intake 144 is defined between the upstream ends of the fourth and fifth annular walls 140 and 142 respectively to supply air into the third annular fuel and air mixing zones 138.

A plurality of tertiary fuel injectors 146 are provided for each of the tubular combustion chambers 236.

Each fourth and fifth annular wall 140,142 is arranged coaxially around the second portion 42 of the respective annular wall. At the downstream end of each third fuel and air mixing zone 138, the fourth and fifth annular walls 140 and 142 are secured to the respective fifth frustoconical portion 132, and each frustoconical portion 132 is provided with a plurality of circumferentially spaced apertures 148 which are arranged to direct fuel and air into a tertiary combustion zone 150, in the tubular combustion chambers 236, in a downstream direction towards the axis of the tubular combustion chambers 236. The apertures 148 may be circular or slots.

In operation primary air A flows through the first air intake 82 and through the first and second radial flow swirlers. The lip 78 directs the primary air into the first fuel and air mixing zone, or primary combustion zone, 64. The flows of air from the first and second radial flow swirlers are in opposite directions to improve mixing turbulence.

The pilot injectors 86 only are used at low power settings, that is less than about 40% power. They inject the gas or pre-evaporated liquid fuel at a narrow angle only into the primary air which has passed through the second radial flow swirlers to create a locally fuel rich mixture on the axes of the tubular combustion chambers 236. Diffusion causes the fuel to mix with the primary air in the vortex B. Vortex C remains an air only region. Thus a locally rich mixture is created on the combustion chamber 236 centreline which sustains combustion in the primary combustion zone 64.

The primary fuel injectors 88 are not used, during low power operation and thus only primary air exits from the downstream end of the passages 72 and 80 formed between the respective vanes 70 and 74 of the first and second swirler assemblies.

At high power settings, at or greater than about 40% power, the pilot injectors 86 are not used, and all the fuel supplied into the combustion chamber 236 is supplied from the primary and secondary injectors 88 and 104 respectively or from the primary, secondary and tertiary injectors 88,104 and 146 respectively.

At high power settings, at or greater than about 40% power, the primary fuel injectors 88 inject gas, or pre-evaporated liquid fuel, into the passages 72 and 80 formed between the respective vanes 70 and 74 of the first and second swirler assemblies. Simultaneously the secondary fuel injectors 104 inject gas, or pre-evaporated liquid fuel, into the second fuel and air mixing zone 94 to mix with the secondary air entering the second fuel and air mixing zone 94 through the second annular intake 102.

The first and second radial flow swirlers direct the fuel and air mixture towards the centreline of the tubular combustion chambers 236 before it is turned so that it flows parallel to the centreline of the combustion chamber 236. The fuel is entrained into both vortex B and vortex C which have opposite swirl, and the shear layer D improves mixing turbulence.

Secondary air E flows through the second air intake 102 into the secondary air and fuel mixing zone 94. The secondary air and fuel is mixed as it flows axially downstream through the second fuel and air mixing zone 94. The resulting fuel and air mixture formed in the secondary air and fuel mixing zone 94 is injected through the apertures 106 into the second portion 42 of the tubular combustion chamber 236 where secondary combustion occurs in the second combustion zone 112.

The reduction in diameter at the downstream end of the first portion 38, provided by the frustoconical portion 120 and the throat 122 allows a suitable margin between the flame temperature in the primary combustion zone 64 and the temperature at which the flame is extinguished with variations in power setting to prevent the flame in the primary combustion zone 64 being extinguished. This enhances the recirculation of hot combustion products into the primary combustion zone 64 to reignite the fuel and mixture.

The reduction in diameter at the downstream end of the second portion 40, provided by the frustoconical portion 134 and the throat 136 allows a suitable margin between the flame temperature in the secondary combustion zone 112 and the temperature at which the flame is extinguished with variations in power setting to prevent the flame in the secondary combustion zone 112 being extinguished. This enhances the recirculation of hot combustion products into the secondary combustion zone 112 to reignite the fuel and air mixture, by producing recirculation zones J.

If the combustion chambers 236 are operated at low ambient air temperatures, in the range of −60° C. to −30° C., the primary and secondary fuel injectors 88 and 104 respectively supply fuel into the primary and secondary combustion zones 64 and 112 respectively for power settings between 40% and 100% power. The tertiary fuel injectors 146 do not supply fuel into the tertiary combustion zone 150 at low ambient air temperatures at any power setting. At low ambient air temperatures the amount of fuel supplied to the primary injectors 88 is increased to maintain the temperature in the primary combustion zone 64 at 1800° K. This is important to ensure optimum combustion for NOx reduction, and to maintain a high enough temperature in the secondary combustion zone 112 for combustion to continue in the secondary combustion zone 112.

If the combustion chambers 236 are operated at high ambient air temperatures, in the region of +30° C. and above, the primary and secondary fuel injectors 88 and 104 respectively supply fuel into the primary and secondary combustion zones 64 and 112 respectively for lower power settings between 40% and a predetermined power setting. At high ambient air temperatures and high power settings between the predetermined power setting and 100% power, the primary, secondary and tertiary fuel injectors 88,104 and 146 respectively supply fuel into the primary, secondary and tertiary combustion zones 64,112 and 150 respectively.

As the ambient air temperature is reduced from the high ambient air temperature, the minimum power setting at which the primary, secondary and tertiary fuel injectors 88,104 and 146 respectively supply fuel into the primary, secondary and tertiary combustion zones 64,112 and 150 respectively increases from the predetermined power setting at high ambient air temperature operation. At low ambient air temperatures, as mentioned previously, the tertiary fuel injectors 146 are not supplied with fuel at any power setting.

At high power and high ambient air temperatures, the temperature in the first fuel and air mixing zone 64 is maintained at about 1800° K., and the temperature in the second combustion zone 112 is maintained at about 1740° K. and the temperature in the tertiary combustion zone 150 is varied between 1550° K. and 1800° K. When the temperature in the tertiary combustion zone 150 falls below 1550° K., the tertiary fuel injectors 146 do not supply fuel to the tertiary combustion zone 150 and the amount of fuel supplied by the secondary fuel injectors 104 into the secondary combustion zone 112 is increased to increase its temperature to 1850° K. The system then acts as a two staged combustor.

The combination of the secondary fuel and air mixing zone 94 and secondary combustion zone 112 together with the tertiary fuel and air mixing zone 138 and tertiary combustion zone 150 allows reduced emissions of NOx to be achieved at all power settings between 40% and 100% power over a wide range of pressure ratios and velocity profiles without the need for variable geometry air intakes for the combustion chambers 236.

The industrial gas turbine engine will be provided with a control system which controls the fuel supplied to the pilot, primary and secondary injectors in accordance with the power demanded for the combustion chambers shown in FIGS. 2 to 5 and 7, The industrial gas turbine engine will be provided with a control system which controls the fuel supplied to the pilot, primary, secondary and tertiary injectors in accordance with the power demanded and the ambient air temperature for the combustion chamber shown in FIG. 8.

We claim:

1. A gas turbine engine combustion chamber having a longitudinal axis and comprising first air intake means, primary fuel injector means and a first fuel and air mixing zone, said first fuel and air mixing zone being defined by at least one annular wall having an upstream end and an upstream wall connected to said upstream end of said annular wall, said annular wall having a longitudinal axis extending coaxially with said longitudinal axis of said combustion chamber at least partly along said axes, said upstream wall having at least one aperture, said first air intake means comprising at least one first flow swirler and at least one second flow swirler for introducing first air into said first fuel and air mixing zone through said aperture in said upstream wall, said first flow swirler and said second flow swirler being disposed at least partly radially with respect to said longitudinal axis and upstream of said annular wall along said axis with said first flow swirler being located closer to said end wall than said second flow swirler, said first flow swirler having vanes to swirl air in one direction, said second flow swirler having vanes to swirl air in a direction generally opposite to said one direction, said vanes of each said flow swirler defining passages therebetween, said primary fuel injector means being located to supply fuel into at least one of said passages between said vanes of said first flow swirler and said vanes of said second flow swirler.

2. The invention as claimed in claim 1, wherein said combustion chamber includes at least one pilot fuel injector aligned with said aperture in said end wall to supply fuel through said aperture into said first fuel and air mixing zone.

3. The invention as claimed in claim 1, wherein said primary fuel injector means is located to supply fuel into each of said passages between said vanes of said first flow swirler.

4. The invention as claimed in claim 1, in which said primary fuel injector means is located to supply fuel into all the passages defined between said vanes of said second flow swirler.

5. The invention as claimed in claim 1, in which said passages have radially outer regions and said primary fuel injector means is located to supply fuel to said radially outer regions.

6. The invention as claimed in claim 1, wherein said primary fuel injector means comprises a hollow cylindrical member located to extend axially with respect to said combustion chamber, said cylindrical member having a plurality of apertures spaced apart along said cylindrical member to inject fuel into said passage.

7. The invention as claimed in claim 6, wherein said apertures are positioned to direct the fuel radially inwardly relative to said axis of said combustion chamber.

8. The invention as claimed in claim 1, in which said combustion chamber is tubular and has a single aperture in said upstream wall.

9. The invention as claimed in claim 2, further comprising secondary air intake means, secondary fuel injector means and a secondary fuel and air mixing zone, said secondary fuel and air mixing zone being annular and surrounding said first fuel and air mixing zone, said secondary fuel and air mixing zone having a radially outer extremity defined by a second annular wall, said secondary fuel injector means being located to supply fuel into said upstream end of said secondary fuel and air mixing zone, said secondary fuel and air mixing zone having a downstream end in fluid flow communication with a secondary combustion zone provided in said combustion chamber downstream of said first fuel and air mixing zone.

10. The invention as claimed in claim 9, wherein said annular wall has a first portion defining said first fuel and air mixing zone, a second portion of increased diameter downstream of said first portion and defining said secondary combustion zone, and a third frusto-conical portion interconnecting the first and second portions.

11. The invention as claimed in claim 10, wherein said downstream end of said first portion of said second annular wall reduces in diameter to a throat.

12. The invention as claimed in claim 9, in which said secondary air intake means is downstream of said first air intake means.

13. The invention as claimed in claim 9, wherein said secondary fuel and air mixing zone is defined at its radially inner extremity by a third annular wall.

14. The invention as claimed in claim 10, wherein said third frusto-conical portion has a plurality of equally circumferentially spaced apertures for directing a secondary fuel and air mixture from said secondary fuel and air mixing zone as a plurality of jets in a downstream direction towards said axis of said combustion chamber.

15. The invention as claimed in claim 14, in which said apertures are slots.

16. The invention as claimed in claim 10, in which said second annular wall has a downstream end which is secured to said third frusto-conical portion of said second annular wall.

17. The invention as claimed in claim 13, wherein said combustion chamber has means for supplying cooling air to an annular chamber defined between said annular wall and said third annular wall.

18. The invention as claimed in claim 9, wherein said secondary fuel injector means comprises a plurality of equi-circumferentially spaced injectors.

19. The invention as claimed in claim 9, further comprising tertiary air intake means, tertiary fuel injector means and a tertiary fuel and air mixing zone, said tertiary fuel and air mixing zone being annular in shape and surrounding said secondary combustion zone, said tertiary fuel and air mixing zone being defined at its radially outer extremity by a fourth annular wall, said tertiary fuel injector means being located to supply fuel into the upstream end of said tertiary fuel and air mixing zone, said tertiary fuel and air mixing zone being in fluid flow communication at its downstream end with a tertiary combustion zone provided in said combustion chamber downstream of said secondary combustion zone.

20. The invention as claimed in claim 19 wherein said annular wall has a fourth portion of larger diameter than said second portion downstream of said second portion and defining the tertiary combustion zone, a fifth frusto-conical portion interconnecting said second and fourth portions.

21. The invention as claimed in claim 19, wherein said downstream end of said first portion of said second annular wall reduces in diameter to a throat.

22. The invention as claimed in claim 19, in which said tertiary air intake means is downstream of said second air intake means.

23. The invention as claimed in claim 19, wherein said tertiary fuel and air mixing zone is defined at its radially inner extremity by a fifth annular wall.

24. The invention as claimed in claim 20, wherein said fifth frusto-conical portion has a plurality of equi-circumferentially spaced apertures for directing a tertiary fuel and air mixture from said tertiary fuel and air mixing zone as a plurality of jets in a downstream direction towards said axis of said combustion chamber.

25. The invention as claimed in claim 24, in which said apertures are slots.

26. The invention as claimed in claim 20, in which said fourth annular wall has a downstream end which is secured to said fifth frusto-conical portion of said annular wall.

27. The invention as claimed in claim 19, wherein said secondary fuel injector means comprises a plurality of equi-circumferentially spaced injectors.

28. A method as claimed in claim 27 in which the predetermined output level is 35–40% power.

29. A method as claimed in claim 28 in which the proportion of fuel supplied from the primary fuel injector means varies from 75% to 50% of the total fuel supplied into the combustion chamber from 40% to 100% output power level.

30. A method of operating a gas turbine engine combustion chamber of the type having a first fuel intake means, primary fuel injector means and a first fuel and air mixing zone, the said zone being defined by at least one annular wall and an upstream wall with said upstream wall being connected to said upstream end of said annular wall, said annular wall having a longitudinal axis extending coaxially with said longitudinal axis of said combustion chamber, said upstream wall having at least one aperture, said first air intake means comprising at least one first flow swirler and at least one second flow swirler for introducing first air into said first fuel and air mixing zone through said aperture in said upstream wall, said first flow swirler and said second flow swirler being disposed at least partly radially with respect to said longitudinal axis and upstream of said annular wall along said axis with said first flow swirler being located closer to said end wall than said second flow swirler, said first flow swirler having vanes to swirl air in one direction, said second flow swirler having vanes to swirl air in a direction generally opposite to said one direction, said vanes of each said flow swirler defining passages therebetween, said primary fuel injector means being located to supply fuel into at least one of said passages between said vanes of said first flow swirler and said vanes of said second flow swirler, said combustion chamber further including a pilot fuel injector, the method comprising:

supplying fuel from the pilot fuel injector only into said first fuel and air mixing zone from the start of operation of the gas turbine engine until a predetermined output power level is obtained, supplying fuel from said primary fuel injector means into at least one of the passages defined between said vanes of said first flow swirler and into at least one of said passages defined between said vanes of said second flow swirler to flow into said first fuel and air mixing zone for output power level greater than the predetermined level, and simultaneously supplying fuel from said secondary fuel injector means into said secondary fuel and air mixing zone to flow into said secondary combustion zone provided in the interior of said combustion chamber downstream of said first fuel and air mixing zone.

31. A method as claimed in claim 30 in which the predetermined output power level is 35 to 40% power.

32. A method of operating a gas turbine engine combustion chamber of the type having a first fuel intake means, primary fuel injector means and a first fuel and air mixing zone, the said zone being defined by at least one annular wall and an upstream wall with said upstream wall being connected to said upstream end of said annular wall, said annular wall having a longitudinal axis extending coaxially with said longitudinal axis of said combustion chamber, said upstream wall having at least one aperture, said first air intake means comprising at least one first flow swirler and at least one second flow swirler for introducing first air into said first fuel and air mixing zone through said aperture in said upstream wall, said first flow swirler and said second flow swirler being disposed at least partly radially with respect to said longitudinal axis and upstream of said annular wall along said axis with said first flow swirler being located closer to said end wall than said second flow swirler, said first flow swirler having vanes to swirl air in one direction, said second flow swirler having vanes to swirl air in a direction generally opposite to said one direction, said vanes of each said flow swirler defining passages therebetween, said primary fuel injector means being located to supply fuel into at least one of said passages between said vanes of said first flow swirler and said vanes of said second flow swirler, said combustion chamber further including a pilot fuel injector, the method comprising:

supplying fuel from said pilot fuel injector only into said first fuel and air mixing zone from the start of operation of the gas turbine engine until a predetermined output power level is obtained, supplying fuel from said primary fuel injector means into at least one of the passages defined between the vanes of said first flow swirler and into at least one of the passages defined between said vanes of said second flow swirler to flow into the first fuel and air mixing zone for output power levels greater than the predetermined level, and simultaneously supplying fuel into the secondary fuel and air mixing zone to flow into the secondary combustion zone provided in the interior of a combustion chamber downstream of the first fuel and air mixing zone, supplying fuel into the tertiary fuel and air mixing zone to flow into the said tertiary combustion zone provided in the interior of said combustion chamber downstream of said secondary combustion zone for output power level greater than a second predetermined level and for ambient air temperature greater than a predetermined temperature.

33. The method as claimed in claim 32 introducing the step of injecting gas fuel with said primary fuel injector means.

34. The method as claimed in claim 32 including the step of injecting evaporated liquid fuel with said primary fuel injector means.

35. A gas turbine engine combustion chamber having a longitudinal axis and comprising first air intake means, primary fuel injector means and a first fuel and air mixing zone, said first fuel and air mixing zone being defined by at least one annular wall having an upstream end and an upstream wall connected to said upstream end of said annular wall, said annular wall having a longitudinal axis extending coaxially with said longitudinal axis of said combustion chamber at least partly along said axes, said upstream wall having at least one aperture, said first air intake means comprising at least one first flow swirler and at least one second flow swirler for introducing first air into said first fuel and air mixing zone through said aperture in said upstream wall, said first flow swirler and said second flow swirler being disposed at least partly radially with respect to said longitudinal axis and upstream of said annular wall along said axis with said first flow swirler being located closer to said end wall than said second flow swirler, said first flow swirler having vanes to swirl air in one direction, said second flow swirler having vanes to swirl air in a direction generally opposite to said one direction, said vanes of each said flow swirler defining passages therebetween, said primary fuel injector means being located to supply fuel into at least one of said passages between said vanes of said first flow swirler and said vanes of said second flow swirler, said combustion chamber including at least one pilot fuel injector aligned with said aperture in said end wall to supply fuel through said aperture into said first fuel and air mixing zone, said combustion chamber further comprising secondary air intake means, secondary fuel injector means and a secondary fuel and air mixing zone, said secondary fuel and air mixing zone being annular and surrounding said first fuel and air mixing zone, said secondary fuel and air mixing zone having a radially outer extremity defined by a second annular wall, said secondary fuel injector means being located to supply fuel into said upstream end of said secondary fuel and air mixing zone, said secondary fuel and air mixing zone having a downstream end in fluid flow communication with a secondary combustion zone provided in said combustion chamber downstream of said first fuel and air mixing zone, said annular wall having a first portion defining said first fuel and air mixing zone, a second portion of increased diameter downstream of said first portion and defining said secondary combustion zone, and a third frusto-conical portion interconnecting the first and second portions, said downstream end of said first portion of said second annular wall reducing in diameter to a throat.

36. A gas turbine engine combustion chamber having a longitudinal axis and comprising first air intake means, primary fuel injector means and a first fuel and air mixing zone, said first fuel and air mixing zone being defined by at least one annular wall having an upstream end and an upstream wall connected to said upstream end of said annular wall, said annular wall having a longitudinal axis extending coaxially with said longitudinal axis of said combustion chamber at least partly along said axes, said upstream wall having at least one aperture, said first air intake means comprising at least one first flow swirler and at least one second flow swirler for introducing first air into said first fuel and air mixing zone through said aperture in said upstream wall, said first flow swirler and said second flow swirler being disposed at least partly radially with respect to said longitudinal axis and upstream of said annular wall along said axis with said first flow swirler being located closer to said end wall than said second flow swirler, said first flow swirler having vanes to swirl air in one direction, said second flow swirler having vanes to swirl air in a direction generally opposite to said one direction, said vanes of each said flow swirler defining passages therebetween, said primary fuel injector means being located to supply fuel into at least one of said passages between said vanes of said first flow swirler and said vanes of said second flow swirler, said combustion chamber including at least one pilot fuel injector aligned with said aperture in said end wall to supply fuel through said aperture into said first fuel and air mixing zone, said combustion chamber further comprising secondary air intake means, secondary fuel injector means and a secondary fuel and air mixing zone, said secondary fuel and air mixing zone being annular and surrounding said first fuel and air mixing zone, said secondary fuel and air mixing zone having a radially outer extremity defined by a second annular wall, said secondary fuel injector means being located to supply fuel into said upstream end of said secondary fuel and air mixing zone, said secondary fuel and air mixing zone having a downstream end in fluid flow communication with a secondary combustion zone provided in said combustion chamber downstream of said first fuel and air mixing zone, said combustion chamber further comprising tertiary air intake means, tertiary fuel injector means and a tertiary fuel and air mixing zone, said tertiary fuel and air mixing zone being annular in shape and surrounding said secondary combustion zone, said tertiary fuel and air mixing zone being defined at its radially outer extremity by a fourth annular wall, said tertiary fuel injector means being located to supply fuel into the upstream end of said tertiary fuel and air mixing zone, said tertiary fuel and air mixing zone being in fluid flow communication at its downstream end with a tertiary combustion zone provided in said combustion chamber downstream of said secondary combustion zone, said annular wall having a fourth portion of larger diameter than said second portion downstream of said second portion and defining the tertiary combustion zone, a fifth frusto-conical portion interconnecting said second and fourth portions.

37. The invention as claimed in claim 36 wherein the downstream end of said second portion of said annular wall reduces in diameter to a throat.

* * * * *